US010717944B2

(12) United States Patent
Shinoda et al.

(10) Patent No.: US 10,717,944 B2
(45) Date of Patent: Jul. 21, 2020

(54) LUBRICATING OIL COMPOSITION

(71) Applicant: SHELL OIL COMPANY, Houston, TX (US)

(72) Inventors: Noriaki Shinoda, Chester (GB); Ryuji Maruyama, Kanagawa (JP); Katsuji Okami, Tokyo (JP)

(73) Assignee: SHELL OIL COMPANY, Houston, TX (US)

( * ) Notice: Subject to any disclaimer, the term of this patent is extended or adjusted under 35 U.S.C. 154(b) by 12 days.

(21) Appl. No.: 15/515,158

(22) PCT Filed: Sep. 28, 2015

(86) PCT No.: PCT/EP2015/072277
§ 371 (c)(1),
(2) Date: Mar. 29, 2017

(87) PCT Pub. No.: WO2016/050700
PCT Pub. Date: Apr. 7, 2016

(65) Prior Publication Data

US 2017/0226443 A1 Aug. 10, 2017

(30) Foreign Application Priority Data

Sep. 30, 2014 (JP) ..... 2014-200669

(51) Int. Cl.

| | |
|---|---|
| ***C10M 145/14*** | (2006.01) |
| ***C10M 171/02*** | (2006.01) |
| ***C10M 171/00*** | (2006.01) |
| ***C10M 101/00*** | (2006.01) |
| ***C10M 101/02*** | (2006.01) |
| ***C10M 105/04*** | (2006.01) |

(52) U.S. Cl.
CPC ..... *C10M 145/14* (2013.01); *C10M 101/00* (2013.01); *C10M 101/02* (2013.01); *C10M 105/04* (2013.01); *C10M 171/00* (2013.01); *C10M 171/02* (2013.01); *C10M 2203/003* (2013.01); *C10M 2203/024* (2013.01); *C10M 2203/1006* (2013.01); *C10M 2203/1025* (2013.01); *C10M 2205/0285* (2013.01); *C10M 2205/173* (2013.01); *C10M 2209/084* (2013.01); *C10N 2220/022* (2013.01); *C10N 2230/02* (2013.01); *C10N 2230/42* (2013.01); *C10N 2230/56* (2013.01); *C10N 2230/68* (2013.01); *C10N 2230/76* (2013.01); *C10N 2240/04* (2013.01)

(58) Field of Classification Search
CPC ..... C10M 111/00; C10M 111/02
USPC ..... 508/469, 110
See application file for complete search history.

(56) References Cited

U.S. PATENT DOCUMENTS

| | | | | |
|---|---|---|---|---|
| 8,318,002 | B2 * | 11/2012 | Baillargeon | C10M 111/02 208/19 |
| 2004/0094453 | A1 * | 5/2004 | Lok | C10M 101/02 208/19 |
| 2007/0191239 | A1 | 8/2007 | Matsuoka et al. | |

FOREIGN PATENT DOCUMENTS

| | | |
|---|---|---|
| EP | 2479249 | 7/2012 |
| JP | 2009520078 | 5/2009 |
| JP | 2011236407 | 11/2011 |
| JP | 2012193255 | 10/2012 |

OTHER PUBLICATIONS

International Search Report dated Nov. 25, 2015; 3 pages.

* cited by examiner

*Primary Examiner* — Prem C Singh
*Assistant Examiner* — Francis C Campanell

(57) ABSTRACT

A lubricating oil composition for automotive transmissions is disclosed. It offers an automotive transmission (especially a fuel-saving type) which satisfies all requirements as regards the properties of resistance to churning, maintenance of the oil film and low-temperature viscosity. It comprises a GTL low viscosity base oil and a Group 1 high viscosity base oil.

7 Claims, No Drawings

LUBRICATING OIL COMPOSITION

PRIORITY CLAIM

The present application is the National Stage (§ 371) of International Application No. PCT/EP2015/072277, filed Sep. 28, 2015, which claims priority from Japanese Patent No. 2014-200669, filed Sep. 30, 2014 incorporated herein by reference.

FIELD OF THE INVENTION

This invention relates to a lubricating oil composition for automotive transmissions. More specifically, the invention relates to a transmission lubricating oil composition of the fuel-saving type which reduces churning resistance through lowering viscosity while maintaining the oil film and preventing damage to the gear-teeth surfaces. In addition, the invention relates to a lubricating oil composition for automotive transmissions which has low low-temperature viscosity and excellent startability in winter.

BACKGROUND OF THE INVENTION

Many lubricating oil compositions have been proposed hitherto. For example, JP2011236407 discloses a Fischer-Tropsch derived base oil (FT oil) which has a high viscosity index and has the merit of reducing the amount of viscosity index improver used. JP2009520078 discloses a lubricating agent obtained by mixing a low-viscosity FT oil with a high viscosity Group 1 oil (solvent refined mineral oil). Further, JP2012193255 discloses a gear oil obtained by mixing a low-viscosity mineral oil-based highly refined oil with a high-viscosity solvent refined mineral oil.

However, the actual situation is that, if it is car transmissions that are taken into consideration as the application, there are no lubricating oil compositions existing in the prior art, which improve fuel economy as required in said application, which have load-resisting properties, and which satisfy all the oil film retention properties and low temperature viscosity characteristics. In order to prevent fatigue damage such as the pitting caused on gear-teeth surfaces, it is important in particular to improve the oil film retention properties. At the same time, in order to improve the load-resisting capability of gear oils, it is necessary to use chemically active additives, but then there is the problem that they cause metal corrosion.

The object of the present invention is therefore to offer an automotive transmission (especially a fuel-saving type) which satisfies all requirements as regards the properties of resistance to churning, maintenance of the oil film and low-temperature viscosity.

SUMMARY OF THE INVENTION

By dint of repeated and intensive investigations to resolve the aforementioned problems, the inventors have discovered that a lubricating oil composition which incorporates a specific amount of a high viscosity Group 1 base oil in a low-viscosity GTL base oil and where the amount of chemically active additive is optimised does give the desired properties. They have thus completed the present invention.

The invention therefore provides a lubricating oil composition for automotive transmissions, characterised in that the lubricating oil composition contains:

(A), as a base oil, a low-viscosity GTL base oil (kinematic viscosity 2 $mm^2/s$ to 5 $mm^2/s$ at 100° C.) and (B) a high-viscosity Group 1 base oil (kinematic viscosity 30 $mm^2/s$ to 35 $mm^2/s$ at 100° C.) in the amount of 2 to 20% by mass based on the total mass of the lubricating oil composition, and in addition (C) the content of the polymeric compound which constitutes the viscosity index improver is 0 to 1.0% by mass based on the total mass of the lubricating oil composition, (D) the pour point is −50° C. or below, the Brookfield viscosity at −40° C. being not more than 10,000 mPa·s, (E) the EHD oil film thickness at 60° C. and 3.0 m/s is not less than 15% as a ratio of the oil film thickness of a polyalphaolefin (kinematic viscosity 4.0 $mm^2/s$ at 100° C.) measured under the same conditions, (F) the kinematic viscosity at 100° C. is 4 $mm^2/s$ to 6 $mm^2/s$, and (G) the kinematic viscosity at 40° C. is 20 $mm^2/s$ to 30 $mm^2/s$.

The invention further provides a method for manufacture of a lubricating oil composition for automotive transmissions, characterised in that the lubricating oil composition contains:

(A), as a base oil, a low-viscosity GTL base oil (kinematic viscosity 2 $mm^2/s$ to 5 $mm^2/s$ at 100° C.) and (B) a high-viscosity Group 1 base oil (kinematic viscosity 30 $mm^2/s$ to 35 $mm^2/s$ at 100° C.) in the amount of 2 to 20% by mass based on the total mass of the lubricating oil composition, and in addition (C) the content of the polymeric compound which constitutes the viscosity index improver is 0 to 1.0% by mass based on the total mass of the lubricating oil composition, (D) the pour point is −50° C. or below, the Brookfield viscosity at −40° C. being not more than 10,000 mPa·s, (E) the EHD oil film thickness at 60° C. and 3.0 m/s is not less than 15% as a ratio of the oil film thickness of a polyalphaolefin (kinematic viscosity 4.0 $mm^2/s$ at 100° C.) measured under the same conditions, (F) the kinematic viscosity at 100° C. is 4 $mm^2/s$ to 6 $mm^2/s$, and (G) the kinematic viscosity at 40° C. is 20 $mm^2/s$ to 30 $mm^2/s$.

According to the present invention, it is possible to offer a lubricating oil composition for use in automotive transmissions which is a lubricating oil composition for use in automotive transmissions of the fuel-economy type which, by reducing churning resistance through lowering the viscosity while maintaining the oil film, prevents damage to gear-teeth surfaces (fatigue damage), and which has low low-temperature viscosity and excellent startability in winter.

DETAILED DESCRIPTION OF THE INVENTION

The lubricating oil composition for automotive transmissions as it pertains to the present embodiment is a high-viscosity Group 1 base oil blended with a low-viscosity GTL base oil. The lubricating oil composition for automotive transmissions as it pertains to its embodiment is explained in more detail below in terms of its specific constituents, the amounts of each constituent in the blend, physical properties and applications, but the invention is in no way limited to these.

What is meant by a GTL base oil is a lubricating base oil obtained by producing a liquefied hydrocarbon by means of the Fischer-Tropsch synthesis process using as raw materials CO and $H_2$ synthesised from natural gas by GTL (Gas To Liquids) technology, then hydrotreating and hydroisomerising the liquefied hydrocarbon and, where necessary, applying catalyst or solvent dewaxing. Compared with mineral oil base oils refined from crude oil, said base oil has an extremely low sulphur content and aromatics content and the paraffin constituent ratio is extremely high, so that it has superior oxidative stability and evaporation losses are very small, which means that it is ideal for the base oil of this invention. The viscosity characteristics of the low-viscosity GTL base oil are not specially limited.

The base oil pertaining to the present invention is a low-viscosity GTL base oil so prepared that within said GTL base oil the kinematic viscosity of the low-viscosity GTL base oil at 100° C. becomes 2 to 5 $mm^2/s$. Low-viscosity GTL base oils may be used singly or as mixtures of a plurality thereof. Said kinematic viscosity is preferably 2.5 to 4.5 $mm^2/s$, but more preferably 2.7 to 4.2 $mm^2/s$. If the kinematic viscosity at 100° C. were to be below 2 $mm^2/s$, it would be necessary to use large amounts of viscosity index improver in order to obtain the kinematic viscosity for the lubricating oil composition mentioned under the aforementioned (F), and in that case a deterioration in shear stability would have to be reckoned with. On the other hand, the kinematic viscosity at 100° C. were to be above 5 $mm^2/s$, it would be difficult to obtain the kinematic viscosity for the lubricating oil composition mentioned under the aforementioned (F). Also, the kinematic viscosity at 40° C. should be 2 to 680 $mm^2/s$ but more preferably 5 to 120 $mm^2/s$. Typically the total sulphur content should also be less than 10 ppm and the total nitrogen content less than 1 ppm. As an example of such a commercial GTL base oil product mention may be made of Shell XHVI (registered trade-mark).

Group 1 base oils include paraffinic mineral oils obtained for example by applying a suitable combination of refining techniques such as solvent refining, hydrorefining or dewaxing to a lubricating oil fraction obtained from atmospheric distillation of a crude oil. The viscosity index is preferably 80 to 120, but more preferably 90 to 110.

The kinematic viscosity of the high-viscosity Group 1 base oil at 100° C. is 30 to 35 $mm^2/s$, but preferably 30.5 to 33.5 $mm^2/s$. If the kinematic viscosity at 100° C. were to be below 30 $mm^2/s$, it would not be possible to maintain an adequate oil film thickness and that would incur deterioration of the lubricity. On the other hand, if the kinematic viscosity at 100° C. were to be above 35 $mm^2/s$, the low-temperature characteristics would deteriorate. It is also best if the total sulphur content is less than 1.5% by mass and preferably less than 1.3% by mass.

It is possible in this invention to include base oils other than the aforementioned base oils, so long as they do not impair the effectiveness of the invention.

It is possible in this invention to use a phosphorus-based additive. For such a phosphorus-based additive it is possible to use any compound normally used as a phosphorus-based additive for lubricating oils, but to give specific examples it is possible to use phosphoric acid monoesters, phosphoric acid diesters, phosphoric acid triesters, phosphorous acid monoesters, phosphorous acid diesters, phosphorous acid triesters, and salts of amines or alkanolamines with these esters. Metallic phosphate salts, and in particular zinc dithiophosphates, are preferred as extreme-pressure additives. An example of a zinc dithiophosphate is indicated by the compound shown in the undermentioned general formula (1).

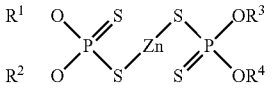

(1)

$R^1$, $R^2$, $R^3$ and $R^4$ in the aforementioned general formula (1) each denote separately a hydrocarbon groups of carbon number 1 to 24. These hydrocarbon groups are desirably any of straight-chain or branched alkyl groups with 1 to 24 carbons, straight-chain or branched alkenyl groups with 3 to 24 carbons, cycloalkyl groups or straight-chain or branched alkyl cycloalkyl groups with 5 to 13 carbons, aryl groups or straight-chain or branched alkylaryl groups with 6 to 18 carbons, and arylalkyl groups with 7 to 19 carbons. In addition, the alkyl groups and alkenyl groups may be any of primary, secondary or tertiary.

As ideal specific examples of the aforementioned zinc dithiophosphates, mention may be made of zinc diisopropyl dithiophosphate, zinc diisobutyl dithiophosphate, zinc di-sec-butyl dithiophosphate, zinc di-sec-pentyl dithiophosphate, zinc di-n-hexyl dithiophosphate, zinc di-sec-hexyl dithiophosphate, zinc dioctyl dithiophosphate, zinc di-2-ethylhexyl dithiophosphate, zinc di-n-decyl dithiophosphate, zinc di-n-dodecyl dithiophosphate, zinc diisotridecyl dithiophosphate, or mixtures constituting combinations of any of these. These phosphorus-based additives may be used singly or may be used in combinations of two or more thereof.

Where necessary, the lubricating oil composition pertaining to this invention may contain antioxidants, ashless dispersants, metallic detergents, friction modifiers, rust preventatives, corrosion inhibiters, defoamers and the like. It is also possible to make use of additive packages in which the aforementioned additives have been packaged for use in automotive transmissions, and it is further possible to use the aforementioned additives jointly with packages.

However, the lubricating oil composition pertaining to this invention ideally should not contain a macropolymer compound as a viscosity index improver. As examples of viscosity index improvers in this case, mention may be made of polymethacrylate and olefin copolymers such as ethylene/propylene glycol co-polymers or styrene/diene co-polymers as non-dispersant type viscosity index improvers, as well as dispersant type viscosity index improvers being those obtained by copolymerisation of these with nitrogen-containing monomers. The thickening effect or viscosity index increment of viscosity index improvers normally increases with the molecular weight thereof. However, as the molecular weight of viscosity index improvers increases, so the shear stability reduces, causing a reduction in viscosity.

Details are explained below as regards the blending of the lubricating oil composition of this invention.

The base oils are incorporated as preferably 70 to 98 mass % but more preferably 80 to 95 mass % relative to the total mass of the lubricating oil composition (100 mass %).

The low-viscosity GTL base oil is incorporated as preferably 50 to 96 mass % but more preferably 60 to 93 mass % relative to the total mass of the lubricating oil composition (100 mass %).

The high-viscosity Group 1 base oil is incorporated as 2 to 20 mass %, but preferably 2 to 15 mass % and more preferably 2 to 10 mass %, relative to the total mass of the lubricating oil composition (100 mass %). If it exceeds 20 mass %, the Brookfield viscosity will exceed 10,000 mPa·s, so that the viscous resistance will become very large, incurring deterioration of the fuel consumption. If it is less than 2 mass %, sufficient oil film thickness will not be obtained and lubricity will suffer.

The phosphorus content of the phosphorus-based additive in terms of amount in the total composition is 0.10 to 0.20 mass %. It is preferably 0.12 to 0.18 mass %. If the amount in the blend is less than 0.10, the friction coefficient increases and gear-speed changes will not be effected smoothly. In addition, the level of load-resisting capability as a gear oil cannot be maintained. But if it is added so as to exceed 0.20 mass %, there will be concern over corrosive wear, and as the friction coefficient will decrease too much there will be a risk that problems may occur with synchronisation during gear-speed changes.

The amount of viscosity index improver in the blend is not more than 1.0 mass %, but preferably not more than 0.5 mass % and more preferably 0 mass %. If the viscosity index improver exceeds 1.0 mass %, the shear stability decreases and becomes lower even than the initial viscosity, so that it becomes impossible to maintain the oil film thickness.

A description is given below of the mutual blend ratios of the constituents making up this invention.

The blend ratio of the low-viscosity GTL base oil and the high-viscosity Group 1 base oil, in terms of their mass, is preferably low-viscosity GTL base oil: high-viscosity Group 1 base oil=1:0.01 to 1:0.30, but more preferably 1:0.02 to 1:0.27.

Next is a detailed explanation of the properties of the lubricating oil composition pertaining to this invention.

The pour point as measured in accordance with JIS K 2269 is −50° C. or lower. If it is higher than −50° C., when said lubricating oil composition is used in vehicles used in cold regions, the lubricating oil will not have the necessary performance to maintain adequate flow characteristics.

The Brookfield viscosity as measured in accordance with DIN 51398, at −40° C., is not more than 10,000 mPa·s. Preferably, the −40° C. Brookfield of the composition should be less than 9000 mPa·s and more preferably less than 8000 mPa·s. When said lubricating oil composition is used in vehicles used in low-temperature environments such as cold regions, if the BF viscosity at −40° C. is higher than 10,000 mPa·s the viscous resistance during churning of the lubricating oil will increase greatly, causing a deterioration in fuel consumption.

The EHD oil film thickness at 60° C. and 3.0 m/s (using an EHD oil film measurement apparatus made by PCS Instruments Ltd.) is not less than 15% as a proportion of the oil film thickness of a polyalphaolefin (viscosity 4.0 $mm^2/s$ at 100° C.) measured under the same conditions, but is preferably not less than 16%. What is meant by oil film thickness in this case is the thickness of the film of lubricating oil formed between frictionally rubbing entities in the elasto-hydrodynamic lubrication domain. If the oil film is thick, it is possible to prevent contact between metal and metal, so that wear is inhibited and it is further possible to extend fatigue life. If, on the other hand, the film is too thin, that is the oil film thickness is less than 15%, it is not possible to inhibit wear adequately and so the fatigue life is also shortened.

The kinematic viscosity at 100° C. as measured in accordance with ASTM D445 is 4 $mm^2/s$ to 6 $mm^2/s$, but preferably 4.5 $mm^2/s$ to 5.5 $mm^2/s$. If the 100° C. kinematic viscosity is lower than 4 $mm^2/s$, the proportion in contact with metal will increase and it will be necessary to reckon with a deterioration in the fuel consumption efficiency due to an increase in friction resistance. If, on the other hand, the 100° C. kinematic viscosity exceeds 6 $mm^2/s$, the effect will be a deterioration in fuel consumption because of an increase in churning resistance.

The kinematic viscosity at 40° C. as measured in accordance with ASTM D445 is 20 $mm^2/s$ to 30 $mm^2/s$, but preferably 22 $mm^2/s$ to 28 $mm^2/s$. If the 40° C. kinematic viscosity is lower than 20 $mm^2/s$, the proportion in contact with metal will increase and it will be necessary to reckon with a deterioration in the fuel consumption efficiency due to an increase in friction resistance. If, on the other hand, the 40° C. kinematic viscosity exceeds 30 $mm^2/s$, the effect will be a deterioration in fuel consumption because of an increase in churning resistance.

An actual car was filled up and the shift handling was evaluated. If normal handing was possible, the evaluation was 0. If it was difficult to go into or out of gear during a shift change, the evaluation was X.

If the added amount of friction modifier such as phosphorus-based additive is too small, the friction coefficient increases and the phenomenon whereby the gear cone and synchroniser ring become difficult to separate arises, along with stick torque. As a result, there is a feeling of the gears being difficult to disengage during a shift change. If the amount added is too large, the friction coefficient decreases and the gear cone and synchroniser ring slip and become unsatisfactory together, so that it becomes hard to go into a gear.

The lubricating oil composition pertaining to this invention is for use in automotive transmissions (gear apparatus, CVT, AT, MT, DCT, Diff, etc.). In particular, the lubricating oil composition pertaining to this invention is suitable for fuel-efficient transmission oils.

The novel finding of the present invention lies in the twin points of superior low-temperature properties and durability with no addition of viscosity index improver, through mixing a specified amount of a high-viscosity Group 1 base oil in a low-viscosity GTL base oil. Because the GTL base oil here has a high viscosity index compared to a conventional highly refined base oil belonging to Group 2 or Group 3, it is possible to obtain a lubricating oil of high viscosity index even if no viscosity index improver is used. As a result, it is possible to increase the viscosity of the base oil itself and so maintain a thick oil film on lubricated surfaces, and hardware protection at metallic contact points such as gear-tooth surfaces is vastly improved. The viscosity index improver here is a high polymer. Consequently, if gear-teeth surfaces or the like are subjected to repeated shear, mechanical shear of the high polymer occurs and the viscosity is reduced, so that fatigue durability of the gear teeth is further worsened. With the lubricating oil composition pertaining to this invention it is possible to combine fuel economy due to a low viscosity with the durability due to preventing damage to the gear-teeth surfaces.

The invention is explained in further detail below by means of examples of embodiment and comparative examples, but the invention is in no way limited by these examples.

The raw materials used in Examples of Embodiment 1 to 10 and Comparative Examples 1 to 10 were as follows:

Base Oil A: a GTL (gas-to-liquid) base oil synthesised by the Fischer-Tropsch method, belonging to Group 2 or Group 3 and using a mixture of blending components of differing viscosities so that the kinematic viscosity at 100° C. of the composition became 5 $mm^2/s$ (Shell XHVI, trade name, made by Showa Shell Ltd.).

Base Oil B: a highly refined mineral oil, belonging to Group 2 or Group 3 and using a mixture of blending components of differing viscosities so that the kinematic viscosity at 100° C. of the composition became 5 $mm^2/s$ (Yubase, trade name, made by SK Lubricants).

Base Oil C: a polyalphaolefin belonging to Group 4 in which the kinematic viscosity at 100° C. is 4.1 $mm^2/s$ and the viscosity index is 128.

Base Oil D: paraffinic mineral oil obtained by refining of crude oil and belonging to Group 1 in which the kinematic viscosity at 100° C. is 32.5 $mm^2/s$ and the viscosity index is 97.

Base Oil E: a polyalphaolefin in which the kinematic viscosity at 100° C. is 40 $mm^2/s$ and the viscosity index is 180.

Additive A: Zn-based GL-4 additives package

Additive B: Phosphorus-based FM additives package

Additive C: PMA-based viscosity index improver

The lubricating oil compositions pertaining to Examples of Embodiment 1 and Comparative Examples 1 to 10 were obtained by mixing and stirring the various constituents with the blend proportions shown in Tables 1 and 2.

100° C. and 40° C. kinematic viscosities, viscosity index, pour point, Brookfield viscosity, KRL shear stability and EHD oil film thickness were measured for the lubricating oil compositions prepared using the make-up of raw materials and method manufacture given above. The results are shown in Tables 1 and 2.

TABLE 1

| | | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|---|
| (Low-viscosity) Base Oil A | mass % | 82.0 | 77.0 | 72.0 | 84.0 | 90.0 | 81.0 | 82.8 | 81.6 | 83.4 | 78.0 |
| Base Oil B | mass % | 0 | 0 | 0 | 0 | 0 | 0 | 0 | 0 | 0 | 0 |
| Base Oil C | mass % | 0 | 0 | 0 | 0 | 0 | 0 | 0 | 0 | 0 | 0 |
| (High-viscosity) Base Oil D | mass % | 10 | 15 | 20 | 8 | 2 | 10 | 10 | 10 | 10 | 10 |
| Base Oil E | mass % | 0 | 0 | 0 | 0 | 0 | 0 | 0 | 0 | 0 | 0 |
| Additive (A) | mass % | 6.0 | 6.0 | 6.0 | 6.0 | 6.0 | 6.0 | 6.0 | 6.0 | 6.0 | 6.0 |
| Additive (B) | mass % | 2.0 | 2.0 | 2.0 | 2.0 | 2.0 | 2.0 | 1.2 | 2.4 | 0.6 | 6.0 |
| Additive (C) | mass % | 0 | 0 | 0 | 0 | 0 | 1 | 0 | 0 | 0 | 0 |
| Total composition | mass % | 100 | 100 | 100 | 100 | 100 | 100 | 100 | 100 | 100 | 100 |
| Phosphorus content | mass % | 0.15 | 0.15 | 0.15 | 0.15 | 0.15 | 0.15 | 0.10 | 0.20 | 0.05 | 0.5 |
| Kinematic viscosity KV40° C. | $mm^2/s$ | 23.10 | 24.34 | 26.63 | 23.53 | 23.66 | 23.17 | 23.24 | 23.69 | 23.10 | 23.89 |
| KV100° C. | $mm^2/s$ | 4.80 | 4.92 | 5.25 | 4.81 | 4.84 | 4.87 | 4.83 | 4.87 | 4.80 | 4.91 |
| Viscosity index VI | | 132 | 128 | 132 | 128 | 129 | 137 | 132 | 131 | 131 | 132 |
| Pour point | ° C. | <−52.5 | −52.5 | −50.0 | <−52.5 | <52.5 | <52.5 | <52.5 | <52.5 | <52.5 | <52.5 |
| BF-40 | mPa · s | 6400 | 9000 | 9500 | 5400 | 3600 | 6200 | 6500 | 6700 | 6300 | 6900 |
| KRL shear stability | | O | O | O | O | O | O | O | O | O | O |
| Oil film thickness | | +16% | +17% | +17% | +16% | +15% | +16% | +16% | +16% | +16% | +16% |
| Shift feeling | | O | O | O | O | O | O | O | O | X | X |

TABLE 2

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|---|---|
| (Low-viscosity) Base Oil A | mass % | 91.0 | 67.0 | 62.0 | 52.0 | 0 | 0 | 82.0 | 0 | 0 | 72.0 |
| Base Oil B | mass % | 0 | 0 | 0 | 0 | 82.0 | 0 | 0 | 82.0 | 0 | 0 |
| Base Oil C | mass % | 0 | 0 | 0 | 0 | 0 | 82.0 | 0 | 0 | 82.0 | 0 |
| (High-viscosity) Base Oil D | mass % | 1 | 25 | 30 | 40 | 10 | 10 | 0 | 0 | 0 | 0 |
| Base Oil E | mass % | 0 | 0 | 0 | 0 | 0 | 0 | 10 | 10 | 10 | 0 |
| Additive (A) | mass % | 6.0 | 6.0 | 6.0 | 6.0 | 6.0 | 6.0 | 6.0 | 6.0 | 6.0 | 6.0 |
| Additive (B) | mass % | 2.0 | 2.0 | 2.0 | 2.0 | 2.0 | 2.0 | 2.0 | 2.0 | 2.0 | 2.0 |
| Additive (C) | mass % | 0 | 0 | 0 | 0 | 0 | 0 | 0 | 0 | 0 | 10 |
| Total composition | mass % | 100 | 100 | 100 | 100 | 100 | 100 | 100 | 100 | 100 | 100 |

TABLE 2-continued

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|---|---|
| Phosphorus content | mass % | 0.15 | 0.15 | 0.15 | 0.15 | 0.15 | 0.15 | 0.15 | 0.15 | 0.15 | 0.15 |
| Kinematic viscosity KV40° C. | $mm^2/s$ | 23.20 | 45.38 | 49.16 | 46.25 | 23.40 | 22.90 | 22.20 | 22.70 | 22.10 | 18.60 |
| KV100° C. | $mm^2/s$ | 4.77 | 9.38 | 9.89 | 7.66 | 4.80 | 4.80 | 4.80 | 4.80 | 4.76 | 4.72 |
| Viscosity index VI | | 128 | 134 | 134 | 133 | 127 | 130 | 142 | 136 | 140 | 187 |
| Pour point | ° C. | <−52.5 | −50 | −45.5 | −35.5 | −45 | <−52.5 | <−52.5 | −45 | <−52.5 | <−52.5 |
| BF-40 | mPa · s | 3400 | >10000 | >10000 | >10000 | 13400 | 4500 | 4800 | 7500 | 3600 | 3000 |
| KRL shear stability | | O | O | O | O | O | O | O | O | O | X |
| Oil film thickness | | +13% | +18% | +20% | +22% | +19% | +13% | +14% | +17% | +11% | +10% |
| Shift feeling | | O | O | O | O | O | O | O | O | O | O |

That which is claimed is:

1. A lubricating oil composition for automotive transmissions comprising:

(A) a GTL low-viscosity base oil having a kinematic viscosity at 100° C. of 2 $mm^2/s$ to 5 $mm^2/s$, wherein said GTL low-viscosity base oil is present in an amount of 60 to 93 mass %, based on the total mass of the lubricating oil composition; and (B) a Group 1 high-viscosity base oil having a kinematic viscosity at 100° C. of 30 to 35 $mm^2/s$, wherein the Group 1 high-viscosity base oil is present in an amount of 2 to 20 mass %, based on the total mass of the lubricating oil composition;

(C) wherein the blend ratio of low-viscosity base oil to high-viscosity base oil, in terms of mass, ranges from 1:0.01 to 1:0.30 wherein the lubricating oil composition comprises at most 1.0 mass % of a viscosity index improver, based on the total mass of the lubricating oil composition, (D) wherein the lubricating oil composition has a pour point of −50° C. or below and a Brookfield viscosity at −40° C. of not more than 10,000mPa·s, (E) wherein the lubricating oil composition has an EHD oil film thickness at 60° C. and 3.0 m/s of not less than 15% as a ratio of the oil film thickness of a polyalphaolefin having a kinematic viscosity at 100° C. of 4.0 $mm^2/s$ measured under the same conditions, (F) wherein the lubricating oil composition has a kinematic viscosity at 100° C. of 4 $mm^2/s$ to 6 $mm^2/s$, (G) wherein the lubricating oil composition has a kinematic viscosity at 40° C. of 20 $mm^2/s$ to 30 $mm^2/s$; and wherein the lubricating oil composition comprises 0.10 to 0.20% by mass in terms of phosphorus content of a phosphorus-based additive, based on the total mass of the lubricating oil composition.

2. A lubricating oil composition according to claim 1, wherein the total amount of base oil present in the lubricating oil composition is 70 to 98 mass %, relative to the total mass of the lubricating oil composition.

3. A lubricating oil composition according to claim 1, wherein the lubricating oil composition comprises at most 0.5 mass % of a viscosity index improver, based on the total mass of the lubricating oil composition.

4. A lubricating oil composition according to claim 1, wherein the lubricating oil composition does not comprise a viscosity index improver.

5. A lubricating oil composition according to claim 1, wherein the lubricating oil composition has a kinematic viscosity at 100° C. of 4.5 $mm^2/s$ to 5.5 $mm^2/s$.

6. A lubricating oil composition according to claim 1, wherein the lubricating oil composition has a kinematic viscosity at 40° C. of 22 $mm^2/s$ to 28 $mm^2/s$.

7. A lubricating oil composition according to claim 1, wherein the Group 1 high-viscosity base oil is present in an amount of 2 to 15 mass %, based on the total mass of the lubricating oil composition.

* * * * *